US008307552B1

(12) United States Patent
Drouillard

(10) Patent No.: US 8,307,552 B1
(45) Date of Patent: Nov. 13, 2012

(54) HEATABLE SHAVING ACCESSORY

(76) Inventor: Gerald E. Drouillard, West Bloomfield, MI (US)

( * ) Notice: Subject to any disclaimer, the term of this patent is extended or adjusted under 35 U.S.C. 154(b) by 1165 days.

(21) Appl. No.: 11/117,193

(22) Filed: Apr. 28, 2005

(51) Int. Cl.
*B26B 21/00* (2006.01)

(52) U.S. Cl. ..... 30/34.05; 30/32; 30/526

(58) Field of Classification Search ..... 30/34.05, 30/526, 537, 32
See application file for complete search history.

(56) References Cited

U.S. PATENT DOCUMENTS 979,296 A * 12/1910 Heissenberger ..... 30/41
1,756,639 A * 4/1930 Greene ..... 30/47
2,083,580 A * 6/1937 Schmitt ..... 30/34.05
2,198,531 A * 4/1940 Fulenwider ..... 30/34.2
2,515,524 A * 7/1950 Manzel ..... 601/119
2,677,883 A * 5/1954 Schallgruber ..... 30/41
2,861,338 A * 11/1958 Boland ..... 30/41
3,895,437 A * 7/1975 DiBuono ..... 30/537
4,074,429 A * 2/1978 Roberts ..... 30/41
4,127,067 A * 11/1978 Dahlgren et al. ..... 101/451
4,845,846 A * 7/1989 Sinka ..... 30/34.2
5,267,399 A * 12/1993 Johnston ..... 30/41
6,182,366 B1 2/2001 Richard ..... 30/50
6,655,028 B2 * 12/2003 Coffin ..... 30/41
6,868,610 B2 * 3/2005 Brandt et al. ..... 30/41
2003/0046816 A1 * 3/2003 Kanzer ..... 30/32

* cited by examiner

*Primary Examiner* — Phong Nguyen
(74) *Attorney, Agent, or Firm* — Young Basile Hanlon & MacFarlane PC

(57) ABSTRACT

A shaving accessory for use with a blade razor of the type having a shaving head and an elongate handle. The accessory includes a slotted cylindrical heat-retaining mass which is adjustably attachable to the handle of the razor by means of a spring arm and clip so that the mass can be brought into an active position proximate to the shaving head where it will contact the skin during the shaving process.

11 Claims, 3 Drawing Sheets

FIG - 2
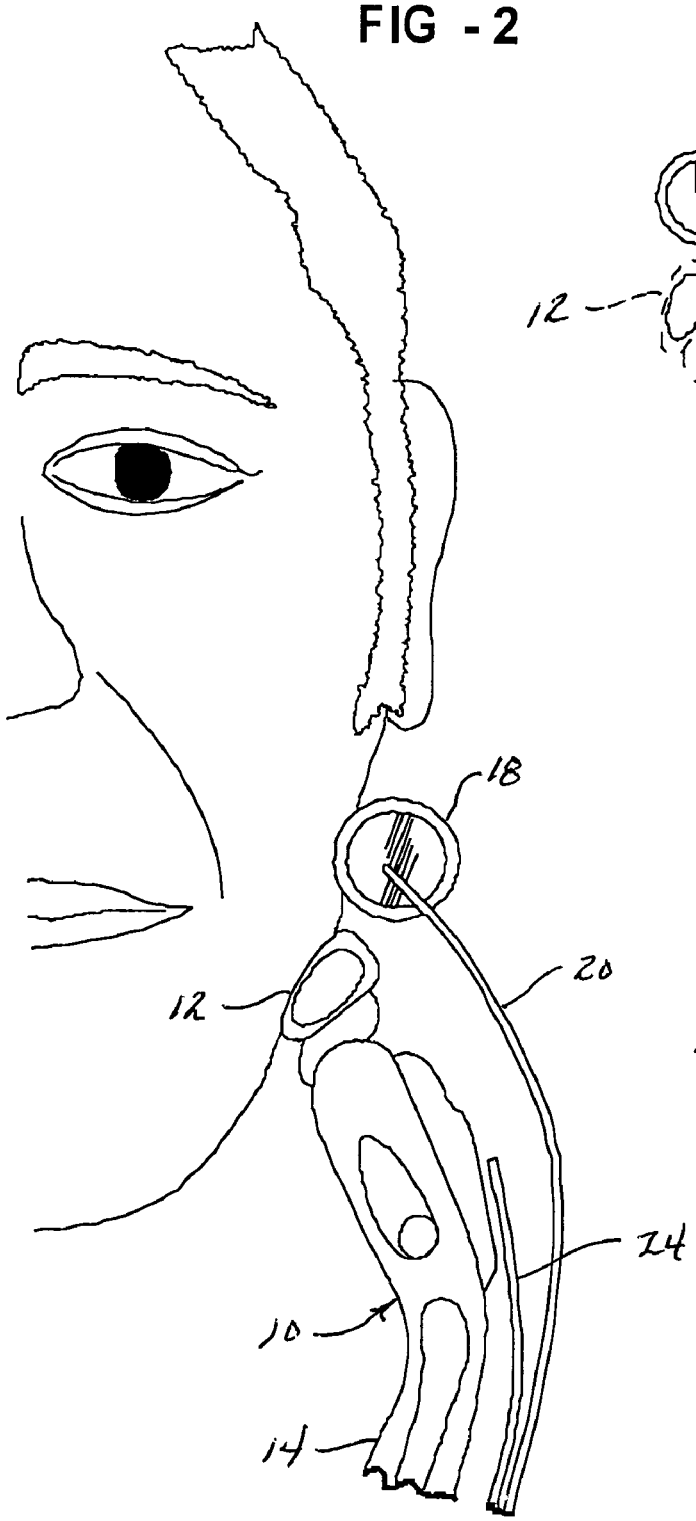
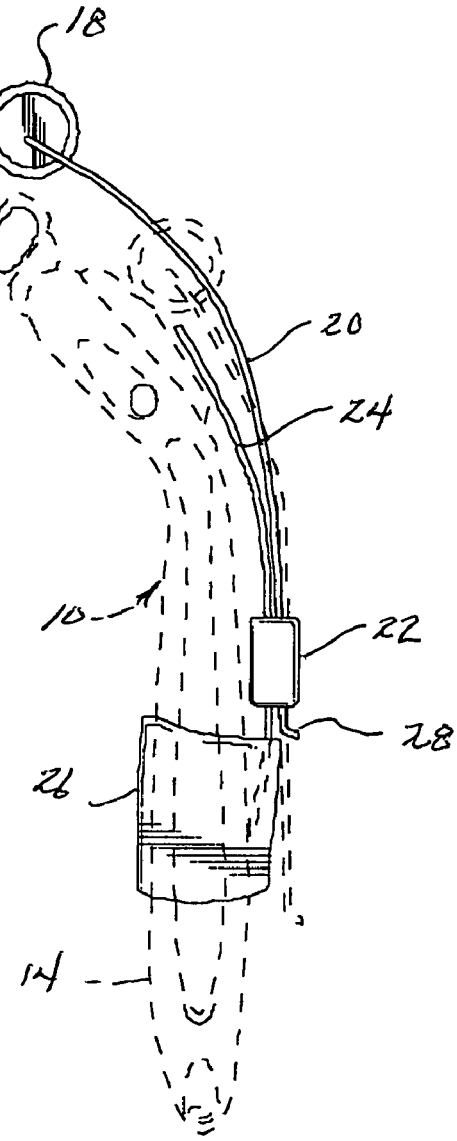
FIG - 3

HEATABLE SHAVING ACCESSORY

FIELD OF THE INVENTION

My invention relates to shaving accessories and more particularly to a shaving accessory for a blade razor which includes a mass of heat retaining material which is brought into contact with the skin of the user while shaving.

BACKGROUND

I have discovered that the use of a manual blade-type razor can be made more comfortable if heat is applied to the skin in the area being shaved during the shaving process; i.e., as the blade of the razor is being applied to the skin to be shaved. The conventional wisdom is that such heat is created through the use of hot towels or by shaving in an atmosphere of elevated temperature such as a shower or sauna.

SUMMARY

I have provided a shaving accessory which makes it possible to apply heat to the skin being shaved during the shaving process and in such a way as to eliminate the need for hot towels and/or shaving in a shower or sauna-like atmosphere. In general my invention comprises adding to a blade razor of the type having a blade head and a handle, a mass of heatable material such as stainless steel positioned near the blade head so as to contact the skin in the area being shaved. In the preferred form, the mass is removably and adjustably attached to the razor handle. Adjustability is a desirable feature since it allows the mass to be retracted to a non-contacting position when desired.

As is hereinafter described in greater detail, the mechanism for attaching the mass to the handle of the razor may take any of a variety of forms. In the preferred and illustrative form hereinafter described in detail, it comprises a spring arm which is integral with the mass so as to extend parallel to the handle of a razor. The spring arm runs through a clip which can be easily attached to the handle of a razor using an elastic strap or the like and which allows selective adjustment of the spring arm along the handle for moving the mass in and out of the active position.

As also hereinafter described in greater detail, the mass is preferable wholly or at least partially cylindrical in shape so as to provide a smooth skin-contacting surface. I also prefer to form the mass with a plurality of parallel slots so as to increase the surface area of the mass and shorten the time necessary to heat the mass by, for example, running it under the hot water tap of a conventional bathroom sink.

According to the method aspect of any invention, I move a heat retaining mass attached to the blade razor into a position proximate the blade head. Thereafter, one follows the steps of (a) heating the mass, and (b) applying the blade head and the heated mass to the skin in the area to be shaved.

The various features and advantages of my invention would be best understood from a reading of the complete specification in which two embodiments of my invention are described in detail.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 2 is a view of the embodiment of FIG. 1 in use;

FIG. 3 is a view of the FIG. 1 embodiment showing the retracted position of the heatable mass;

DETAILED DESCRIPTION OF THE ILLUSTRATIVE EMBODIMENTS

Figure 1:
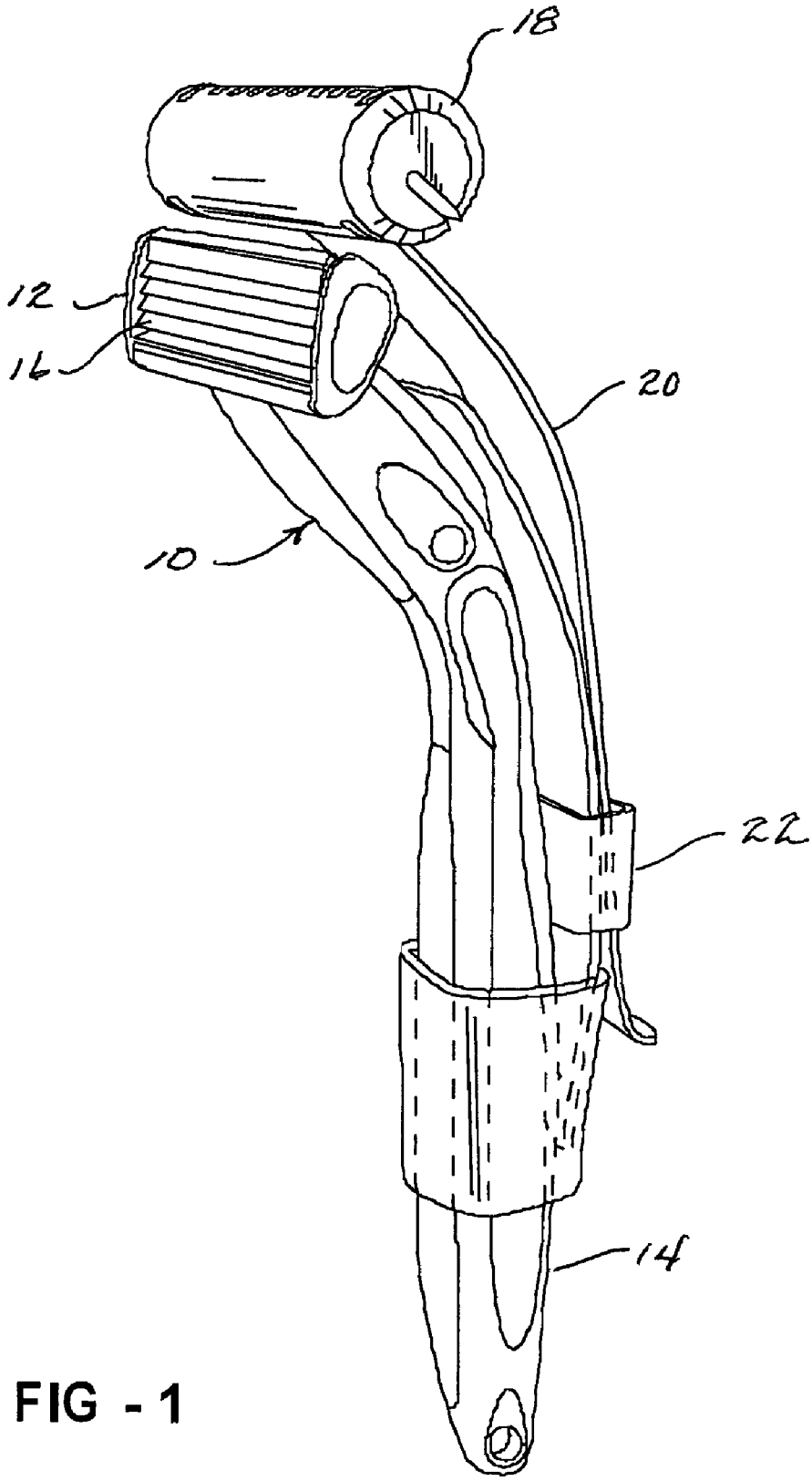
FIG. 1 is a perspective view of a first embodiment of my invention.
Figure 4:
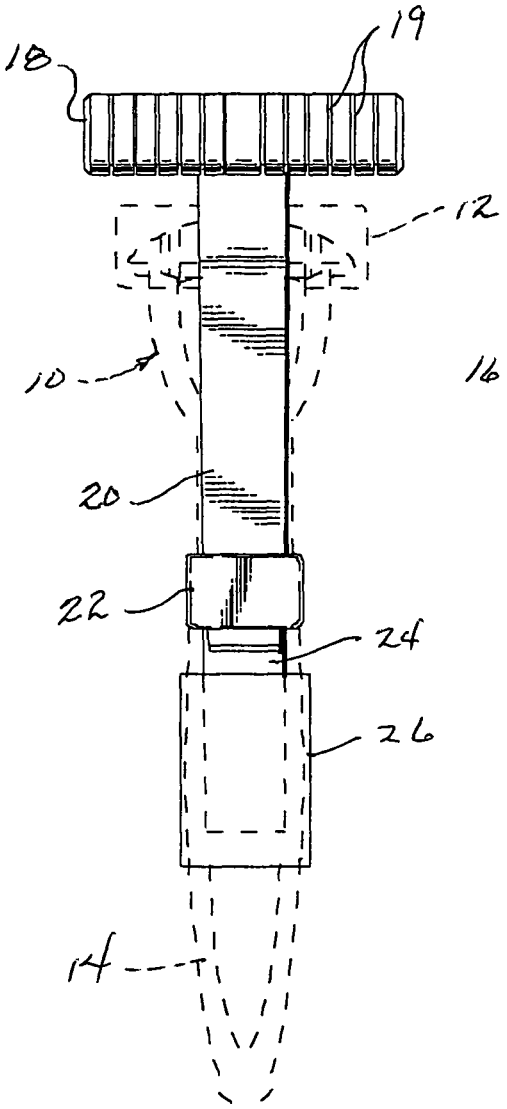
FIG. 4 is a rear view of the FIG. 1 embodiment.

Referring to FIGS. 1 through 4, there is shown a conventional blade razor 10 comprising the combination of a shaving head 12 and an elongate handle 14. The shaving head 12 is of the type which is equipped with multiple permanent blades 16 which can be used to contact and shave skin in a well known fashion. However, it will be understood the shavers with replaceable blades can also be used with my invention.

In accordance with my invention, I provide as an accessory to the shaver 10 a cylindrical mass 18 of a size and shape which approximates that of the shaving head 12. The mass 18 is made of a heat-retaining material such as stainless steel or plated copper and is provided with slots 19 which increase the surface area of the mass and make it possible to heat the mass rapidly by, for example, running it under a hot water tap. Attached to the mass 18 is a spring arm 20 which is frictionally adjustably associated with a stainless steel clip 22 having an integral strap 24 which, in the case of FIGS. 1 and 2, underlies the arm 20 and is secured to the razor handle 14 by means of an elastic strap 26. The combination of the spring arm 20 and the clip 22 allows the spring arm 20 to be adjusted along the length of the handle 14 so as to move the mass 18 between an active skin contacting position as shown in said lines in FIG. 3 and a retracted position as shown in broken lines in FIG. 3. Moving the mass to the retracted position allows the razor to be used in "tight" places without undesirable interference. The stainless steel spring arm 20 preferably has a rolled end 28 to facilitate the application of finger pressure to the spring arm to move it up and down along the razor handle 14, as well as to retain it within the clip 22.

Figure 5:
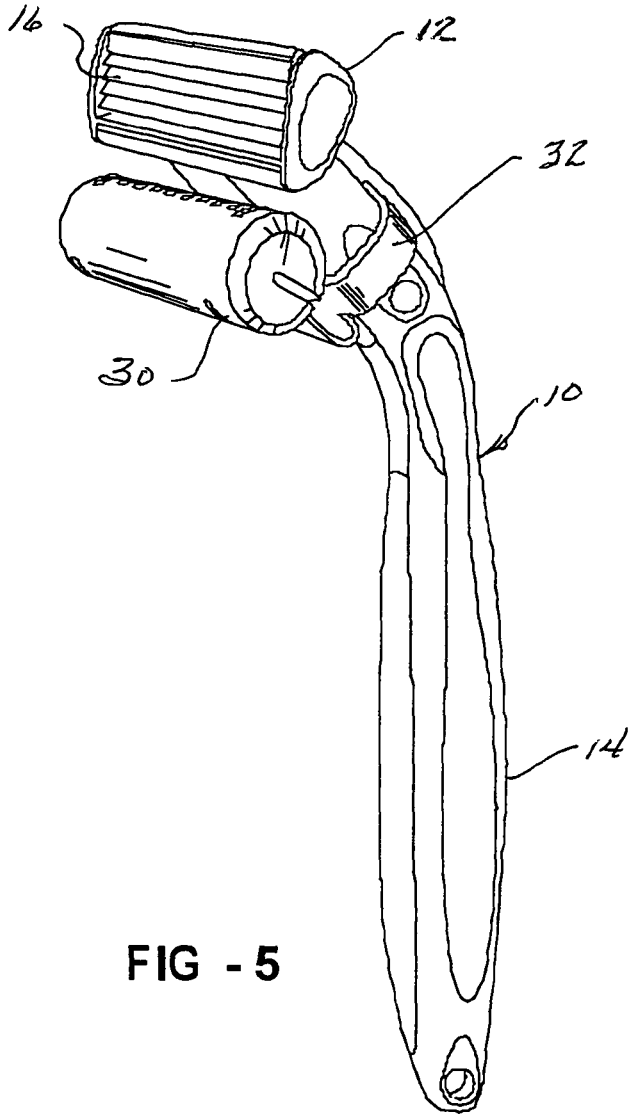
FIG. 5 is a perspective view of a second embodiment of my invention.

As shown in FIG. 5, the accessory of my invention may also be attached to the handle 14 of the razor 10 to underlie the handle 14. In this embodiment, stainless steel mass 30 of cylindrical shape is attached to razor handle 14 by a clip 32 so as to be positioned just under and parallel to shaver head 12. This is a non-retractable design, but can be made retractable using the principles of the embodiment of FIGS. 1-4. A given accessory will typically be designed for one or the other of the two positions described herein, but can be used with some razors in either position. It will be understood that the particular mechanism which is used to attach the spring arm 20 or an equivalent thereof to a razor handle may vary widely from those which are frictionally adjustable along the length of the handle to those which are fixed and/or use detents for adjustment. It is also within the scope of my invention to permanently attach the mass 18 to a razor of the type accepting a disposable blade cartridge.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A shaving process comprising the steps of:

a) attaching a cylindrical mass of high heat-retaining metal selected from the group consisting of stainless steel and plated copper to a blade razor having a shaving head containing a blade and an elongate handle extending from the shaving head, the attachment step being carried out such that the mass is spaced above the shaving head and out of contact therewith during a shaving operation;

b) heating the mass; and c) shaving with the razor in such a way that the mass contacts the skin in the area being shaved.

2. A shaving accessory for use applying heat to an area being shaved with a razor having a shaving head and an elongate handle extending from the shaving head comprising:

a mass made entirely of metal having a smooth exterior surface free of raised features and an elongate spring arm integral therewith; and a substantially cylindrical clip for securing the spring arm to the razor handle such that the smooth exterior surface of the mass is proximate to but spaced from the shaving head where it contacts an area being shaved.

3. A shaving accessory as defined in claim 2 wherein the mass is substantially cylindrical and is slotted at right angles to the axis of cylindrical symmetry.

4. A shaving accessory as defined in claim 2 wherein the mass is made at least in part of stainless steel.

5. In combination, a blade razor having a shaving head and an elongate handle extending from the shaving head;

a cylindrical mass of high heat-retaining metal and having an elongate appendage extending therefrom; and a clip for slidably attaching the appendage to the razor handle such that the mass is proximate to but spaced above the shaving head and in contact with the area being shaved during a shaving operation.

6. A shaving accessory for applying heat to an area being shaved with a razor having a shaving head and an elongate handle extending from the shaving head, said accessory comprising a smooth surfaced mass of non-absorbent, non-soluble heat-retaining metal and having approximately the same dimensions as the shaving head, a clip for attaching the mass to the elongate razor handle such that the mass is proximate but spaced from the shaving head and in contact with an area being shaved; said accessory further including an elongate spring arm integral with the mass and slidably extending through the clip for adjusting the position of the mass relative to the shaving head of the razor when attached thereto.

7. A shaving accessory for applying heat to an area being shaved with a razor having a shaving head with a blade and an elongate handle extending from the shaving head, said accessory comprising;

a mass made entirely of non-absorbent, non-soluble high heat retaining metal; and means for selectively adjustably attaching the mass to the razor handle so as to enable the mass to be positioned proximate to but spaced from the blade and in contact with an area being shaved.

8. A shaving accessory as defined in claim 7, wherein said means for adjustably attaching comprises a clip securable to the razor handle and a spring arm integral with the mass and extending through the clip for sliding adjustment relative thereto.

9. A shaving accessory for applying heat to an area being shaved use with a razor having a shaving head with at least one blade and an elongate handle extending from the shaving head, said accessory comprising:

a rigid mass made substantially entirely of high heat retaining metal material; said mass being at least partially cylindrical and of a size and shape approximating the size and shape of the head;

an elongate arm attached to the mass and extending from the mass; and a clip for attaching the arm to the elongate razor handle such that the mass is proximate but spaced from the shaving head and blade and in a position to make contact with an area being shaved.

10. The shaving accessory as defined in claim 9 wherein the mass is made of metal which has formed therein a plurality of spaced and laterally extending open slots.

11. A shaving accessory as defined in claim 9 wherein the material of the mass is selected from the group consisting of stainless steel and plated copper.

* * * * *